US010210831B2

(12) United States Patent
Xing et al.

(10) Patent No.: US 10,210,831 B2
(45) Date of Patent: Feb. 19, 2019

(54) DRIVE METHOD OF LIQUID CRYSTAL DISPLAY DEVICE AND LIQUID CRYSTAL DISPLAY DEVICE

(71) Applicant: Wuhan China Star Optoelectronics Technology Co., Ltd., Wuhan (CN)

(72) Inventors: Zhenzhou Xing, Wuhan (CN); Chunpeng Guo, Wuhan (CN); Xingling Guo, Wuhan (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 81 days.

(21) Appl. No.: 15/505,104

(22) PCT Filed: Dec. 27, 2016

(86) PCT No.: PCT/CN2016/112442
§ 371 (c)(1),
(2) Date: Feb. 20, 2017

(87) PCT Pub. No.: WO2018/090443
PCT Pub. Date: May 24, 2018

(65) Prior Publication Data

US 2018/0226044 A1 Aug. 9, 2018

(30) Foreign Application Priority Data

Nov. 21, 2016 (CN) ..... 2016 1 1042356

(51) Int. Cl.
*G09G 3/36* (2006.01)

(52) U.S. Cl.
CPC ..... *G09G 3/3655* (2013.01); *G09G 3/36* (2013.01); *G09G 2320/0276* (2013.01);
(Continued)

(58) Field of Classification Search
CPC .. G09G 2354/00; G09G 5/006; G09G 3/3696; G09G 2320/0626;
(Continued)

(56) References Cited

U.S. PATENT DOCUMENTS

2006/0097969 A1* 5/2006 Tsai ..... G09G 3/20 345/88
2007/0052735 A1* 3/2007 Chou ..... H04N 9/69 345/690

(Continued)

*Primary Examiner* — Sanjiv D. Patel
(74) *Attorney, Agent, or Firm* — Leong C. Lei

(57) ABSTRACT

The present provides a drive method of a liquid crystal display device and a liquid crystal display device. By burning sets of OTP data corresponding to the use durations which are different in a drive chip, and each set of OTP data comprises a gamma datum and a Vcom datum, and the liquid crystal display device selects the OTP data corresponding to the use duration according to the present use duration, and uses the gamma datum and the Vcom datum in the set of OTP data to drive a display panel to perform image display for avoiding that the gamma value deviates from the target gamma value, and the Vcom deviates from the best Vcom to ensure that the liquid crystal display device always uses the target gamma value and the best Vcom for driving, and always guarantee the display result and quality of the panel.

9 Claims, 2 Drawing Sheets

(52) U.S. Cl.
CPC ..... *G09G 2320/0285* (2013.01); *G09G 2320/0673* (2013.01); *G09G 2320/0693* (2013.01)

(58) Field of Classification Search
CPC ..... G09G 2320/0673; G09G 3/3655; G09G 2320/0247; G09G 3/3688; G09G 2320/0204; G09G 2320/0285
See application file for complete search history.

(56) References Cited

U.S. PATENT DOCUMENTS

| | | | | |
|---|---|---|---|---|
| 2008/0111805 | A1* | 5/2008 | Chang | G09G 3/006 345/208 |
| 2009/0040163 | A1* | 2/2009 | Sun | G09G 3/3696 345/98 |
| 2009/0207120 | A1* | 8/2009 | Lin | G09G 3/2096 345/100 |
| 2009/0243987 | A1* | 10/2009 | Chang | G09G 3/3655 345/94 |
| 2009/0315872 | A1* | 12/2009 | Ikeda | G09G 3/3614 345/209 |
| 2016/0019850 | A1* | 1/2016 | Chuang | G09G 3/3607 345/690 |
| 2017/0116956 | A1* | 4/2017 | Yang | G09G 5/10 |

* cited by examiner

DRIVE METHOD OF LIQUID CRYSTAL DISPLAY DEVICE AND LIQUID CRYSTAL DISPLAY DEVICE

FIELD OF THE INVENTION

The present invention relates to a display technology field, and more particularly to a drive method of a liquid crystal display device and a liquid crystal display device.

BACKGROUND OF THE INVENTION

With the development of display technology, the flat panel device, such as Liquid Crystal Display (LCD) possesses advantages of high image quality, power saving, thin body and wide application scope. Thus, it has been widely applied in various consumer electrical products, such as mobile phone, television, personal digital assistant, digital camera, notebook, laptop, and becomes the major display device.

The Thin Film Transistor (TFT) liquid crystal display device is the most common display device at present. The Thin Film Transistor liquid crystal display device controls the input of the display data signal with the thin film transistors, and thus to control the image display. Specifically, each liquid crystal pixel dot on the liquid crystal display device is driven by the thin film transistor integrated behind it. With the drive of the thin film transistor, the high speed, high brightness, high contrast display screen information can be achieved. The electrical property of the thin film transistor will drift as time goes by. The reason is that more defects exist at the interface of the amorphous silicon and the silicon nitride (SiNx). The long time bias will lead to the charge accumulation at the interface of the amorphous silicon and the silicon nitride. The electrical field formed by these charges will overlap with the gate voltage to result in the threshold voltage (Vth) drift of the thin film transistor, and then the electrical property of the thin film transistor drifts. Ultimately, it results in the drift of the voltage-transmission rate curve (V-T curve) of the panel and influences the display quality.

At present, the Gamma adjustment and the Flicker adjustment are required to perform before the TFT-LCD leaves the factory. The gamma value of the gamma curve of the TFT-LCD is adjusted to be the target gamma value (2.2) and the common voltage (Vcom) value is adjusted to be the best Vcom for making blink values lowest to obtain a set of a gamma datum and a Vcom datum. Specifically, for some gray scale, an initial voltage is first outputted. Then the pixel brightness is tested to judge whether the relationship of the two satisfies the 2.2 power exponent relation. If it is not satisfied, the initial voltage is adjusted, and then the pixel brightness is tested to judge whether the relationship of the two satisfies the 2.2 power exponent relation, again until the final voltage that makes the relationship of the two satisfy the 2.2 power exponent relation is found. The aforesaid process is repeated to find out the final voltage of the preset certain gray scale to obtain the gamma data of making the gamma value of the gamma curve of the TFT-LCD is equal to 2.2.

However, after the adjusted liquid crystal display device has been used for a period of time, the electrical property of the thin film transistor will drift as time goes by, and then the gamma curve deviates from gamma 2.2, and Vcom value deviates from the best Vcom to ultimately lead to that the display result is getting worse. Namely, the longer the liquid crystal display device is used, the worse the display result becomes. Consequently, it is required to provide a method to maintain the liquid crystal display device with the high quality display.

SUMMARY OF THE INVENTION

An objective of the present invention is to provide a drive method of a liquid crystal display device, which can guarantee that a gamma value of a gamma curve of the liquid crystal display device is always the target gamma value in a long time, and a Vcom value is always the best Vcom to ensure that the display result of the liquid crystal display device does not decrease as time goes by.

Another objective of the present invention is to provide a liquid crystal display device, which can guarantee that a gamma value of a gamma curve of the liquid crystal display device is always the target gamma value in a long time, and a Vcom value is always the best Vcom to ensure that the display result of the liquid crystal display device does not decrease as time goes by.

For realizing the aforesaid objectives, the present invention provides a drive method of a liquid crystal display device, comprising steps of:

step 1, providing a liquid crystal display device, and the liquid crystal display device comprising: a display panel, and a drive chip electrically coupled to the display panel;

step 2, providing a plurality sets of OTP data of the liquid crystal display device corresponding to a plurality of use durations which are different, and each set of OTP data comprises: a gamma datum and a Vcom datum;

step 3, burning the plurality sets of OTP data of the liquid crystal display device corresponding to the plurality of use durations which are different in the drive chip of the liquid crystal display device;

step 4, selecting a set of OTP data corresponding to the use duration according to a present use duration of the liquid crystal display device with the drive chip, and using the gamma datum and the Vcom datum in the set of OTP data to drive the display panel to perform image display.

Step 2 comprises: providing a plurality of liquid crystal display devices having different use durations, and sequentially measuring gamma data and Vcom data making blink values of the respective liquid crystal display devices minimum of the respective liquid crystal display devices having the different use durations under a preset target gamma value to obtain the plurality sets of OTP data of the liquid crystal display device corresponding to the plurality of use durations which are different;

Step 2 comprises: first providing a plurality of test groups, and each test group comprises the plurality of liquid crystal display devices, and the use durations of the liquid crystal display devices in the same test group are the same, the use durations of the liquid crystal display devices in different test groups are different, and then sequentially measuring the OTP data corresponded with each test group to obtain the plurality of test groups of the liquid crystal display device corresponding to the different use durations;

wherein a test process of the OTP data corresponded with each test group is: measuring the gamma datum and the Vcom datum making a blink value of the each liquid crystal display device minimum of liquid crystal display device in the test group under a preset target gamma value, and respectively averaging gamma data and Vcom data of the respective liquid crystal display devices in the test group to obtain the gamma data and the Vcom data corresponded with the test group, i.e. the OTP data corresponded with the use duration corresponded with the test group.

The preset target gamma value is 2.2.

Four sets of OTP data provided in step 2 respectively are a first set of OTP data, a second set of OTP data, a third set of OTP data and a fourth set of OTP data;

in step 4, the drive chip selects the gamma datum and the Vcom datum in the first set of OTP data to perform image display in the first year of using the liquid crystal display device; the drive chip selects the gamma datum and the Vcom datum in the second set of OTP data to perform image display from the first year to the second year of using the liquid crystal display device; the drive chip selects the gamma datum and the Vcom datum in the third set of OTP data to perform image display from the second year to the third year of using the liquid crystal display device; the drive chip selects the gamma datum and the Vcom datum in the fourth set of OTP data to perform image display after the third year of using the liquid crystal display device.

The present invention further provides a liquid crystal display device, comprising: a display panel, and a drive chip electrically coupled to the display panel;

a plurality sets of OTP data of the liquid crystal display device corresponding to a plurality of use durations which are different are burned in the drive chip, and each set of OTP data comprises: a gamma datum and a Vcom datum;

as displaying, the drive chip selects a set of OTP data corresponding to the use duration according to a present use duration of the liquid crystal display device, and uses the gamma datum and the Vcom datum in the set of OTP data to drive the display panel to perform image display.

Obtaining the plurality sets of OTP data of the liquid crystal display device corresponding to the plurality of use durations which are different is: providing a plurality of liquid crystal display devices having different use durations, and sequentially measuring gamma data and Vcom data making blink values of the respective liquid crystal display devices minimum of the respective liquid crystal display devices having the different use durations under a preset target gamma value to obtain the plurality sets of OTP data of the liquid crystal display device corresponding to the plurality of use durations which are different.

Obtaining the plurality sets of OTP data of the liquid crystal display device corresponding to the plurality of use durations which are different is: first providing a plurality of test groups, and each test group comprises the plurality of liquid crystal display devices, and the use durations of the liquid crystal display devices in the same test group are the same, the use durations of the liquid crystal display devices in different test groups are different, and then sequentially measuring the OTP data corresponded with each test group to obtain the plurality of test groups of the liquid crystal display device corresponding to the different use durations;

wherein a test process of the OTP data corresponded with each test group is: measuring the gamma datum and the Vcom datum making a blink value of the each liquid crystal display device minimum of liquid crystal display device in the test group under a preset target gamma value, and respectively averaging gamma data and Vcom data of the respective liquid crystal display devices in the test group to obtain the gamma data and the Vcom data corresponded with the test group, i.e. the OTP data corresponded with the use duration corresponded with the test group.

The preset target gamma value is 2.2.

Four sets of OTP data burned in the drive chip respectively are a first set of OTP data, a second set of OTP data, a third set of OTP data and a fourth set of OTP data;

the drive chip selects the gamma datum and the Vcom datum in the first set of OTP data to perform image display in the first year of using the liquid crystal display device; the drive chip selects the gamma datum and the Vcom datum from the second set of OTP data to perform image display in the first year to the second year of using the liquid crystal display device; the drive chip selects the gamma datum and the Vcom datum in the third set of OTP data to perform image display from the second year to the third year of using the liquid crystal display device; the drive chip selects the gamma datum and the Vcom datum in the fourth set of OTP data to perform image display after the third year of using the liquid crystal display device.

The present invention further provides a drive method of a liquid crystal display device, comprising steps of:

step 1, providing a liquid crystal display device, and the liquid crystal display device comprising: a display panel, and a drive chip electrically coupled to the display panel;

step 2, providing a plurality sets of OTP data of the liquid crystal display device corresponding to a plurality of use durations which are different, and each set of OTP data comprises: a gamma datum and a Vcom datum;

step 3, burning the plurality sets of OTP data of the liquid crystal display device corresponding to the plurality of use durations which are different in the drive chip of the liquid crystal display device;

step 4, selecting a set of OTP data corresponding to the use duration according to a present use duration of the liquid crystal display device with the drive chip, and using the gamma datum and the Vcom datum in the set of OTP data to drive the display panel to perform image display;

wherein step 2 comprises: providing a plurality of liquid crystal display devices having different use durations, and sequentially measuring gamma data and Vcom data making blink values of the respective liquid crystal display devices minimum of the respective liquid crystal display devices having the different use durations under a preset target gamma value to obtain the plurality sets of OTP data of the liquid crystal display device corresponding to the plurality of use durations which are different;

wherein four sets of OTP data provided in step 2 respectively are a first set of OTP data, a second set of OTP data, a third set of OTP data and a fourth set of OTP data;

in step 4, the drive chip selects the gamma datum and the Vcom datum in the first set of OTP data to perform image display in the first year of using the liquid crystal display device; the drive chip selects the gamma datum and the Vcom datum in the second set of OTP data to perform image display from the first year to the second year of using the liquid crystal display device; the drive chip selects the gamma datum and the Vcom datum in the third set of OTP data to perform image display from the second year to the third year of using the liquid crystal display device; the drive chip selects the gamma datum and the Vcom datum in the fourth set of OTP data to perform image display after the third year of using the liquid crystal display device.

The benefits of the present invention are: the present provides a drive method of a liquid crystal display device and a liquid crystal display device. By burning a plurality sets of OTP data corresponding to the plurality of use durations which are different in a drive chip, and each set of OTP data comprises a gamma datum and a Vcom datum, and the liquid crystal display device selects the OTP data corresponding to the use duration according to the present use duration, and uses the gamma datum and the Vcom datum in the set of OTP data to drive a display panel to perform image display for avoiding that the gamma value of the liquid crystal display device deviates from the target gamma value, and the Vcom deviates from the best Vcom to ensure that the liquid crystal display device always uses the target gamma value and the best Vcom for driving, and always guarantee the display result and quality of the panel. The present invention further provides a liquid crystal display device, which can guarantee that a gamma value of a gamma curve of the liquid crystal display device is always the target gamma value in a long time, and a Vcom value is always the best Vcom to ensure that the display result of the liquid crystal display device does not decrease as time goes by.

BRIEF DESCRIPTION OF THE DRAWINGS

In order to better understand the characteristics and technical aspect of the invention, please refer to the following detailed description of the present invention is concerned with the diagrams, however, provide reference to the accompanying drawings and description only and is not intended to be limiting of the invention.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 2:
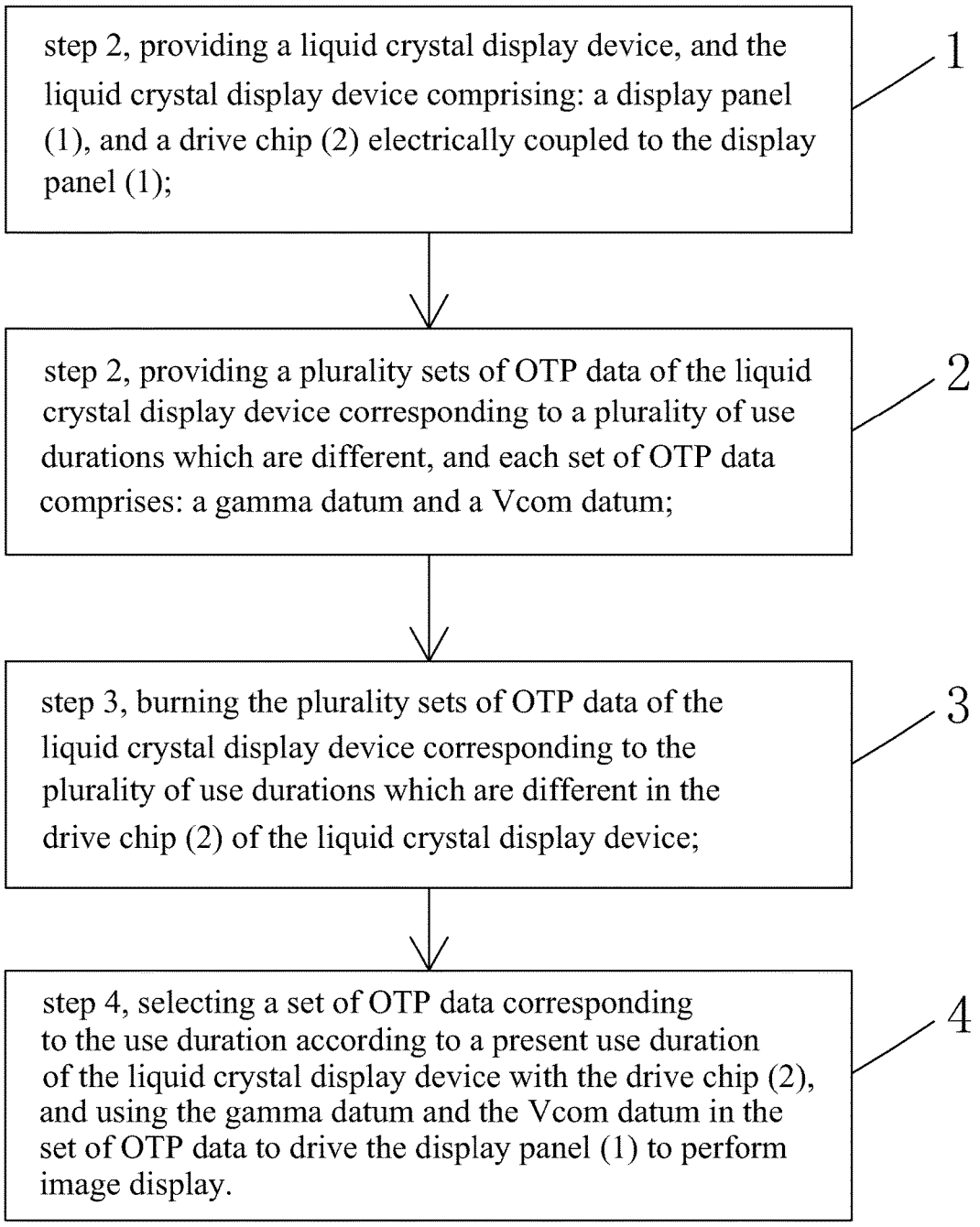
FIG. 2 is a flowchart of a drive method of a liquid crystal display device of the present invention.

Please refer to FIG. 2. The present invention first provides a drive method of a liquid crystal display device, comprising steps of:

step 1, providing a liquid crystal display device, and the liquid crystal display device comprising: a display panel 1, and a drive chip 2 electrically coupled to the display panel 1;

step 2, providing a plurality sets of OTP (One Time Programmable) data of the liquid crystal display device corresponding to a plurality of use durations which are different, and each set of OTP data comprises: a gamma datum and a Vcom datum.

Selectably, step 2 comprises: providing a plurality of liquid crystal display devices having different use durations, and sequentially measuring gamma data and Vcom data making blink values of the respective liquid crystal display devices minimum of the respective liquid crystal display devices having the different use durations under a preset target gamma value to obtain the plurality sets of OTP data of the liquid crystal display device corresponding to the plurality of use durations which are different; For an illustration, the liquid crystal display devices which are never used, used for one year, used for two years and used for three years are respectively provided. The gamma data and the Vcom data making blink values minimum of the liquid crystal display devices which are never used, used for one year, used for two years and used for three years while the gamma value is equal to 2.2 to respectively obtain the gamma datum and the Vcom datum which should be used by the liquid crystal display device in the first year, the gamma datum and the Vcom datum which should be used by the liquid crystal display device from the first year to the second year, the gamma datum and the Vcom datum which should be used by the liquid crystal display device from the second year to the third year, and the gamma datum and the Vcom datum which should be used by the liquid crystal display device after the third year.

Selectably, step 2 comprises: first providing a plurality of test groups, and each test group comprises the plurality of liquid crystal display devices, and the use durations of the liquid crystal display devices in the same test group are the same, the use durations of the liquid crystal display devices in different test groups are different, and then sequentially measuring the OTP data corresponded with each test group to obtain the plurality of test groups of the liquid crystal display device corresponding to the different use durations; wherein a test process of the OTP data corresponded with each test group is: measuring the gamma datum and the Vcom datum making a blink value of the each liquid crystal display device minimum of liquid crystal display device in the test group under a preset target gamma value, and respectively averaging gamma data and Vcom data of the respective liquid crystal display devices in the test group to obtain the gamma data and the Vcom data corresponded with the test group, i.e. the OTP data corresponded with the use duration corresponded with the test group. For an illustration, ten liquid crystal display devices which are never used, used for one year, ten liquid crystal display devices which are used for two years and ten liquid crystal display devices which are used for three years are respectively provided respectively to serve as the test group never used, the test group used for one year, the test group used for two years and the test group used for three years. First, the gamma data and the Vcom data making blink values minimum of the ten liquid crystal display devices in the test group never used while the gamma value is equal to 2.2 are measured, and the gamma data and the Vcom data of the ten liquid crystal display devices in the test group never used are respectively averaged to obtain the gamma datum and the Vcom datum of the test group never used. Then, the same method is used to measure the gamma datum and the Vcom datum of the test group used for one year, the test group used for two years and the test group used for three years. Finally, the gamma datum and the Vcom datum which should be used by the liquid crystal display device in the first year, the gamma datum and the Vcom datum which should be used by the liquid crystal display device from the first year to the second year, the gamma datum and the Vcom datum which should be used by the liquid crystal display device from the second year to the third year and the gamma datum and the Vcom datum which should be used by the liquid crystal display device after the third year are obtained. The test error can be reduced with the measurement of averaging the plurality of liquid crystal display devices to promote accuracy of the measured gamma datum and the Vcom datum.

step 3, burning the plurality sets of OTP data of the liquid crystal display device corresponding to the plurality of use durations which are different in the drive chip 2 of the liquid crystal display device.

Specifically, the drive chip 2 utilizes the drive chip which only supports one time burning as the same as prior art. The difference is that in the present invention, many sets of OTP data are burned, and each set of OTP data comprises a gamma datum and a Vcom datum. Thus, the different gamma data and a Vcom data can be selected to drive the display panel for working according to the use duration change of the liquid crystal display to ensure that the liquid crystal display device always works under the target gamma value and best Vcom anytime. However, only one set of OTP data is burned in prior art, the liquid crystal display device only can select the gamma datum and the Vcom datum in the OTP data as working. Along with the increase of the use duration, the TFT property in the liquid crystal display device will change, and the threshold voltage will drift. Then, once the original gamma datum and the Vcom datum is still used, the gamma value of the gamma curve of the liquid crystal display device will deviate from the target gamma value (2.2), and Vcom datum will deviate from the best Vcom making blink values minimum to result in that the display result gets worse and worse.

step 4, selecting a set of OTP data corresponding to the use duration according to a present use duration of the liquid crystal display device with the drive chip 2, and using the gamma datum and the Vcom datum in the set of OTP data to drive the display panel 1 to perform image display.

For an illustration, according to the gamma data and the Vcom data making blink values minimum of the liquid crystal display devices which are never used, used for one year, used for two years and used for three years while the gamma value is equal to 2.2, which are measured in step 2, the drive chip 2 selects the gamma datum and the Vcom datum of the liquid crystal display device never used while the gamma value is equal to 2.2 which is measured in step 2 to drive the display panel 1 to perform image display in the first year of using the liquid crystal display device; the drive chip 2 selects the gamma datum and the Vcom datum of the liquid crystal display device used for one year while the gamma value is equal to 2.2 which is measured in step 2 to drive the display panel 1 to perform image display from the first year to the second year of using the liquid crystal display device; the drive chip 2 selects the gamma datum and the Vcom datum of the liquid crystal display device used for two years while the gamma value is equal to 2.2 which is measured in step 2 to drive the display panel 1 to perform image display from the second year to the third year of using the liquid crystal display device; the drive chip 2 selects the gamma datum and the Vcom datum of the liquid crystal display device used for three years while the gamma value is equal to 2.2 which is measured in step 2 to drive the display panel 1 to perform image display after the third year of using the liquid crystal display device.

Figure 1:
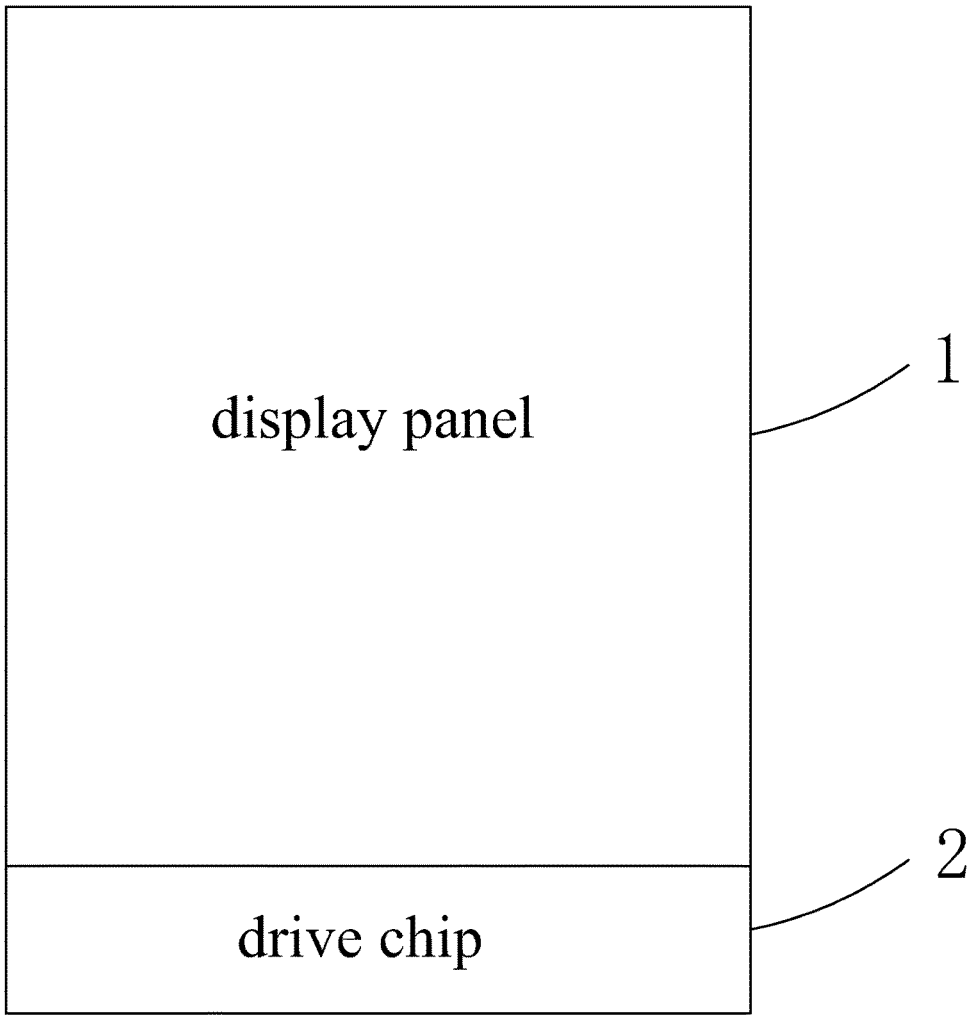
FIG. 1 is a structure diagram of a liquid crystal display device of the present invention.

Please refer to FIG. 1. The present invention further provides a liquid crystal display device, comprising a display panel 1, and a drive chip 2 electrically coupled to the display panel 1;

a plurality sets of OTP data of the liquid crystal display device corresponding to a plurality of use durations which are different are burned in the drive chip 2, and each set of OTP data comprises: a gamma datum and a Vcom datum;

as displaying, the drive chip 2 selects a set of OTP data corresponding to the use duration according to a present use duration of the liquid crystal display device, and uses the gamma datum and the Vcom datum in the set of OTP data to drive the display panel 1 to perform image display.

Selectably, obtaining the plurality sets of OTP data of the liquid crystal display device corresponding to the plurality of use durations which are different is: providing a plurality of liquid crystal display devices having different use durations, and sequentially measuring gamma data and Vcom data making blink values of the respective liquid crystal display devices minimum of the respective liquid crystal display devices having the different use durations under a preset target gamma value to obtain the plurality sets of OTP data of the liquid crystal display device corresponding to the plurality of use durations which are different. For an illustration, the liquid crystal display devices which are never used, used for one year, used for two years and used for three years are respectively provided. The gamma data and the Vcom data making blink values minimum of the liquid crystal display devices which are never used, used for one year, used for two years and used for three years while the gamma value is equal to 2.2 to respectively obtain the gamma datum and the Vcom datum which should be used by the liquid crystal display device in the first year, the gamma datum and the Vcom datum which should be used by the liquid crystal display device from the first year to the second year, the gamma datum and the Vcom datum which should be used by the liquid crystal display device from the second year to the third year, and the gamma datum and the Vcom datum which should be used by the liquid crystal display device after the third year.

Selectably, obtaining the plurality sets of OTP data of the liquid crystal display device corresponding to the plurality of use durations which are different also can be: first providing a plurality of test groups, and each test group comprises the plurality of liquid crystal display devices, and the use durations of the liquid crystal display devices in the same test group are the same, the use durations of the liquid crystal display devices in different test groups are different, and then sequentially measuring the OTP data corresponded with each test group to obtain the plurality of test groups of the liquid crystal display device corresponding to the different use durations; wherein a test process of the OTP data corresponded with each test group is: measuring the gamma datum and the Vcom datum making a blink value of the each liquid crystal display device minimum of liquid crystal display device in the test group under a preset target gamma value, and respectively averaging gamma data and Vcom data of the respective liquid crystal display devices in the test group to obtain the gamma data and the Vcom data corresponded with the test group, i.e. the OTP data corresponded with the use duration corresponded with the test group. For an illustration, ten liquid crystal display devices which are never used, used for one year, ten liquid crystal display devices which are used for two years and ten liquid crystal display devices which are used for three years are respectively provided respectively to serve as the test group never used, the test group used for one year, the test group used for two years and the test group used for three years. First, the gamma data and the Vcom data making blink values minimum of the ten liquid crystal display devices in the test group never used while the gamma value is equal to 2.2 are measured, and the gamma data and the Vcom data of the ten liquid crystal display devices in the test group never used are respectively averaged to obtain the gamma datum and the Vcom datum of the test group never used. Then, the same method is used to measure the gamma datum and the Vcom datum of the test group used for one year, the test group used for two years and the test group used for three years. Finally, the gamma datum and the Vcom datum which should be used by the liquid crystal display device in the first year, the gamma datum and the Vcom datum which should be used by the liquid crystal display device from the first year to the second year, the gamma datum and the Vcom datum which should be used by the liquid crystal display device from the second year to the third year and the gamma datum and the Vcom datum which should be used by the liquid crystal display device after the third year are obtained. The test error can be reduced with the measurement of averaging the plurality of liquid crystal display devices to promote accuracy of the measured gamma datum and the Vcom datum.

Specifically, the drive chip 2 utilizes the drive chip which only supports one time burning as the same as prior art. The difference is that in the present invention, many sets of OTP data are burned, and each set of OTP data comprises a gamma datum and a Vcom datum. Thus, the different gamma data and a Vcom data can be selected to drive the display panel for working according to the use duration change of the liquid crystal display to ensure that the liquid crystal display device always works under the target gamma value and best Vcom anytime. However, only one set of OTP data is burned in prior art, the liquid crystal display device only can select the gamma datum and the Vcom datum in the OTP data as working. Along with the increase of the use duration, the TFT property in the liquid crystal display device will change, and the threshold voltage will drift. Then, once the original gamma datum and the Vcom datum is still used, the gamma value of the gamma curve of the liquid crystal display device will deviate from the target gamma value (2.2), and Vcom datum will deviate from the best Vcom making blink values minimum to result in that the display result gets worse and worse.

In conclusion, the present provides a drive method of a liquid crystal display device and a liquid crystal display device. By burning a plurality sets of OTP data corresponding to the plurality of use durations which are different in a drive chip, and each set of OTP data comprises a gamma datum and a Vcom datum, and the liquid crystal display device selects the OTP data corresponding to the use duration according to the present use duration, and uses the gamma datum and the Vcom datum in the set of OTP data to drive a display panel to perform image display for avoiding that the gamma value of the liquid crystal display device deviates from the target gamma value, and the Vcom deviates from the best Vcom to ensure that the liquid crystal display device always uses the target gamma value and the best Vcom for driving, and always guarantee the display result and quality of the panel. The present invention further provides a liquid crystal display device, which can guarantee that a gamma value of a gamma curve of the liquid crystal display device is always the target gamma value in a long time, and a Vcom value is always the best Vcom to ensure that the display result of the liquid crystal display device does not decrease as time goes by.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A drive method of a liquid crystal display device, comprising steps of:

step 1, providing a liquid crystal display device, and the liquid crystal display device comprising: a display panel, and a drive chip electrically coupled to the display panel;

step 2, providing a plurality sets of OTP data of the liquid crystal display device corresponding to a plurality of use durations which are different, and each set of OTP data comprises: a gamma datum and a Vcom datum;

step 3, burning the plurality sets of OTP data of the liquid crystal display device corresponding to the plurality of use durations which are different in the drive chip of the liquid crystal display device;

step 4, selecting a set of OTP data corresponding to the use duration according to a present use duration of the liquid crystal display device with the drive chip, and using the gamma datum and the Vcom datum in the set of OTP data to drive the display panel to perform image display, wherein step 2 comprises: providing a plurality of liquid crystal display devices having different use durations, and sequentially measuring gamma data and Vcom data making blink values of the respective liquid crystal display devices minimum of the respective liquid crystal display devices having the different use durations under a preset target gamma value to obtain the plurality sets of OTP data of the liquid crystal display device corresponding to the plurality of use durations which are different.

2. The drive method of the liquid crystal display device according to claim 1, wherein the preset target gamma value is 2.2.

3. A drive method of a liquid crystal display device, comprising steps of:

step 1, providing a liquid crystal display device, and the liquid crystal display device comprising: a display panel, and a drive chip electrically coupled to the display panel;

step 2, providing a plurality sets of OTP data of the liquid crystal display device corresponding to a plurality of use durations which are different, and each set of OTP data comprises: a gamma datum and a Vcom datum;

step 3, burning the plurality sets of OTP data of the liquid crystal display device corresponding to the plurality of use durations which are different in the drive chip of the liquid crystal display device;

step 4, selecting a set of OTP data corresponding to the use duration according to a present use duration of the liquid crystal display device with the drive chip, and using the gamma datum and the Vcom datum in the set of OTP data to drive the display panel to perform image display, wherein step 2 comprises: first providing a plurality of test groups, and each test group comprises the plurality of liquid crystal display devices, and the use durations of the liquid crystal display devices in the same test group are the same, the use durations of the liquid crystal display devices in different test groups are different, and then sequentially measuring the OTP data corresponded with each test group to obtain the plurality of test groups of the liquid crystal display device corresponding to the different use durations;

wherein a test process of the OTP data corresponded with each test group is: measuring the gamma datum and the Vcom datum making a blink value of the each liquid crystal display device minimum of liquid crystal display device in the test group under a preset target gamma value, and respectively averaging gamma data and Vcom data of the respective liquid crystal display devices in the test group to obtain the gamma data and the Vcom data corresponded with the test group, i.e. the OTP data corresponded with the use duration corresponded with the test group.

4. A liquid crystal display device, comprising: a display panel, and a drive chip electrically coupled to the display panel;

a plurality sets of OTP data of the liquid crystal display device corresponding to a plurality of use durations which are different being burned in the drive chip, and each set of OTP data comprising: a gamma datum and a Vcom datum;

as displaying, the drive chip selecting a set of OTP data corresponding to the use duration according to a present use duration of the liquid crystal display device, and using the gamma datum and the Vcom datum in the set of OTP data to drive the display panel to perform image display, wherein obtaining the plurality sets of OTP data of the liquid crystal display device corresponding to the plurality of use durations which are different is: providing a plurality of liquid crystal display devices having different use durations, and sequentially measuring gamma data and Vcom data making blink values of the respective liquid crystal display devices minimum of the respective liquid crystal display devices having the different use durations under a preset target gamma value to obtain the plurality sets of OTP data of the liquid crystal display device corresponding to the plurality of use durations which are different.

5. The liquid crystal display device according to claim 4, wherein the preset target gamma value is 2.2.

6. The liquid crystal display device according to claim 4, wherein four sets of OTP data burned in the drive chip respectively are a first set of OTP data, a second set of OTP data, a third set of OTP data and a fourth set of OTP data;

the drive chip selects the gamma datum and the Vcom datum in the first set of OTP data to perform image display in the first year of using the liquid crystal display device; the drive chip selects the gamma datum and the Vcom datum from the second set of OTP data to perform image display in the first year to the second year of using the liquid crystal display device; the drive chip selects the gamma datum and the Vcom datum in the third set of OTP data to perform image display from the second year to the third year of using the liquid crystal display device; the drive chip selects the gamma datum and the Vcom datum in the fourth set of OTP data to perform image display after the third year of using the liquid crystal display device.

7. A liquid crystal display device, comprising: a display panel, and a drive chip electrically coupled to the display panel;

a plurality sets of OTP data of the liquid crystal display device corresponding to a plurality of use durations which are different being burned in the drive chip, and each set of OTP data comprising: a gamma datum and a Vcom datum;

as displaying, the drive chip selecting a set of OTP data corresponding to the use duration according to a present use duration of the liquid crystal display device, and using the gamma datum and the Vcom datum in the set of OTP data to drive the display panel to perform image display, wherein obtaining the plurality sets of OTP data of the liquid crystal display device corresponding to the plurality of use durations which are different is: first providing a plurality of test groups, and each test group comprises the plurality of liquid crystal display devices, and the use durations of the liquid crystal display devices in the same test group are the same, the use durations of the liquid crystal display devices in different test groups are different, and then sequentially measuring the OTP data corresponded with each test group to obtain the plurality of test groups of the liquid crystal display device corresponding to the different use durations;

wherein a test process of the OTP data corresponded with each test group is: measuring the gamma datum and the Vcom datum making a blink value of the each liquid crystal display device minimum of liquid crystal display device in the test group under a preset target gamma value, and respectively averaging gamma data and Vcom data of the respective liquid crystal display devices in the test group to obtain the gamma data and the Vcom data corresponded with the test group, i.e. the OTP data corresponded with the use duration corresponded with the test group.

8. A drive method of a liquid crystal display device, comprising steps of:

step 1, providing a liquid crystal display device, and the liquid crystal display device comprising: a display panel, and a drive chip electrically coupled to the display panel;

step 2, providing a plurality sets of OTP data of the liquid crystal display device corresponding to a plurality of use durations which are different, and each set of OTP data comprises: a gamma datum and a Vcom datum;

step 3, burning the plurality sets of OTP data of the liquid crystal display device corresponding to the plurality of use durations which are different in the drive chip of the liquid crystal display device;

step 4, selecting a set of OTP data corresponding to the use duration according to a present use duration of the liquid crystal display device with the drive chip, and using the gamma datum and the Vcom datum in the set of OTP data to drive the display panel to perform image display;

wherein step 2 comprises: providing a plurality of liquid crystal display devices having different use durations, and sequentially measuring gamma data and Vcom data making blink values of the respective liquid crystal display devices minimum of the respective liquid crystal display devices having the different use durations under a preset target gamma value to obtain the plurality sets of OTP data of the liquid crystal display device corresponding to the plurality of use durations which are different;

wherein four sets of OTP data provided in step 2 respectively are a first set of OTP data, a second set of OTP data, a third set of OTP data and a fourth set of OTP data;

in step 4, the drive chip selects the gamma datum and the Vcom datum in the first set of OTP data to perform image display in the first year of using the liquid crystal display device; the drive chip selects the gamma datum and the Vcom datum in the second set of OTP data to perform image display from the first year to the second year of using the liquid crystal display device; the drive chip selects the gamma datum and the Vcom datum in the third set of OTP data to perform image display from the second year to the third year of using the liquid crystal display device; the drive chip selects the gamma datum and the Vcom datum in the fourth set of OTP data to perform image display after the third year of using the liquid crystal display device.

9. The drive method of the liquid crystal display device according to claim 8, wherein the preset target gamma value is 2.2.

* * * * *